US008459927B2

(12) United States Patent
England et al.

(10) Patent No.: US 8,459,927 B2
(45) Date of Patent: Jun. 11, 2013

(54) VERTICAL LIFT ARM DEVICE

(75) Inventors: Mark L. England, Dunlap, IL (US); David Reyes, Peoria, IL (US); Sean Plante, Clearwater, KS (US); Ed Wagner, Wichita, KS (US)

(73) Assignee: CNH America LLC, New Holland, PA (US)

( * ) Notice: Subject to any disclaimer, the term of this patent is extended or adjusted under 35 U.S.C. 154(b) by 884 days.

(21) Appl. No.: 12/511,152

(22) Filed: Jul. 29, 2009

(65) Prior Publication Data

US 2011/0027056 A1 Feb. 3, 2011

(51) Int. Cl.
*E02F 342/00* (2006.01)
*B66C 23/00* (2006.01)

(52) U.S. Cl.
USPC ..... 414/686; 414/685; 414/917

(58) Field of Classification Search
USPC ..... 414/686, 685, 917
See application file for complete search history.

(56) References Cited

U.S. PATENT DOCUMENTS

| | | | | |
|---|---|---|---|---|
| 4,355,946 | A | 10/1982 | Wykhuis et al. | |
| 5,542,814 | A * | 8/1996 | Ashcroft et al. | 414/815 |
| 6,325,589 | B1 | 12/2001 | Jang et al. | |
| 6,695,568 | B2 | 2/2004 | Bares et al. | |
| 6,796,762 | B2 | 9/2004 | Vicars, III et al. | |
| 6,854,951 | B2 | 2/2005 | Mimuro | |
| 6,866,466 | B2 | 3/2005 | Roan et al. | |
| 6,997,667 | B2 | 2/2006 | Hackett et al. | |
| 7,128,518 | B2 | 10/2006 | Yamashita | |
| 7,214,026 | B2 | 5/2007 | Hilvers et al. | |
| 2002/0064445 | A1 * | 5/2002 | Dershem et al. | 414/686 |

FOREIGN PATENT DOCUMENTS

| | | |
|---|---|---|
| EP | 1 081 292 A1 | 3/2001 |
| JP | 2006 249709 | 9/2006 |

* cited by examiner

*Primary Examiner* — Scott Lowe
(74) *Attorney, Agent, or Firm* — Sue C. Watson

(57) ABSTRACT

A skid steer loader having an operator compartment attached to a frame. Lift assemblies are movably mounted to the frame and are movable between a retracted position and an extended position. As the lift assemblies are moved between the retracted position and the extended position, joining plates, first links and second links are positioned behind the operator compartment to provide a better field of vision for the operator.

10 Claims, 9 Drawing Sheets

VERTICAL LIFT ARM DEVICE

FIELD OF THE INVENTION

The present invention relates to a loader arm device, and in particular, to a vertical lift arm device for use on a skid steer loader.

BACKGROUND OF THE INVENTION

Skid steer loaders are compact vehicles useful on farms and construction sites to maneuver in tight spaces and transport heavy or bulky items. Typical skid steer loaders include a boom that can be raised and lowered and a bucket attached to the end of the boom whereby items can be lifted off the ground, transported, and placed back on the ground or dumped into a receptacle with high walls, such as a dump truck. The skid steer loaders are generally considered to have either a radial lift load-arm, in which the boom has a single pivot point, or a vertical lift load-arm, in which a four-bar linkage is used to raise and lower the boom.

Operators want to be able to service their skid steer loader easily. The operator compartment of a skid steer loader typically pivots on the frame to reveal engine components for servicing. Four-bar linkage designs generally provide a linkage that is coupled to the operator compartment, complicating the pivoting of the operator compartment and making access to engine components difficult.

In addition, operators need to have a good view of their surroundings when the boom is in the down position. Radial lift skid steer loaders generally obstruct the operator's view, thereby creating potential safety concerns.

It would, therefore, be beneficial to have a skid steer loader which allows the operator compartment to be opened for improved service access and which provides enhanced visibility for the operator when the boom is lowered for improved safety.

SUMMARY OF THE INVENTION

One aspect of the invention is directed to a skid steer loader having an operator compartment attached to a frame. Lift assemblies are movably mounted to the frame and are movable between a retracted position and an extended position. Joining plates are rigidly coupled to the lift assemblies. First links are pivotally coupled to the frame proximate a back of the operator compartment and are pivotally coupled to the joining plates. Second links are pivotally coupled to the frame proximate a back of the operator compartment and are pivotally coupled to the joining plates. As the lift assemblies are moved between the retracted position and the extended position, the joining plates, the first links and the second links are positioned behind the operator compartment to provide a better field of vision for the operator.

Another aspect of the invention is directed to a skid steer loader having an operator compartment attached to a frame. Lift assemblies are movably mounted to the frame and are movable between a retracted position and an extended position. First links are coupled to the lift assemblies and are pivotally coupled to a back portion of the frame proximate a back surface of the operator compartment. Second links are coupled to the lift assemblies and are pivotally coupled to the frame proximate the back surface of the operator compartment. The second links are pivotally coupled to the frame at a position above where the first links are pivotally coupled to the frame. The lift assemblies have lift arms which extend from the first and second links in a direction toward a front of the frame. When the lift assemblies are in the retracted position, the field of vision from the operator compartment is unobstructed.

Another aspect of the invention is directed to a skid steer loader having a frame with a first link, a second link and a lift actuator coupled thereto. The first link is pivotally coupled to the frame at a first-link pivot and the second link is pivotally coupled to the frame at a second-link pivot. The lift actuator is adapted to extend and retract between a fully retracted position and a fully extended position. The lift actuator is pivotally coupled to the frame at a lift actuator pivot. A joining plate is pivotally coupled to the first link, the second link and the lift actuator at a first-link-plate pivot, a second-link-plate pivot and a lift-actuator-plate pivot, respectively. A boom is rigidly coupled to the joining plate. The second link and the lift actuator are positioned so that in response to movement of the actuator from the retracted position to the fully extended position, the second link and the lift actuator remain coplanar.

In one embodiment of the skid steer loader described herein, the operator will have a generally unobstructed field of view of the work area and surroundings regardless of the position of the lift assemblies or, thereby providing for ease of operation and increased safety. In addition, the operator compartment may be easily opened or pivoted to allow for better service access to parts of the engine and other components. In addition, as the first links, the second links and the lift actuators may be mounted on the frame at the rear of the skid steer loader, the operator compartment can easily be pivoted forward whether the lift assemblies are lowered or raised or in any position therebetween. The positioning of the pivot points on the frame, where substantial structure must be provided to strengthen the base regardless of the presence of the pivot points, obviates the need to provide additional structure to support the lift assembly. Also, the placement of the lift actuator is such that the full lift height of the bucket is achieved with a shorter actuator than is possible with some prior-art designs.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
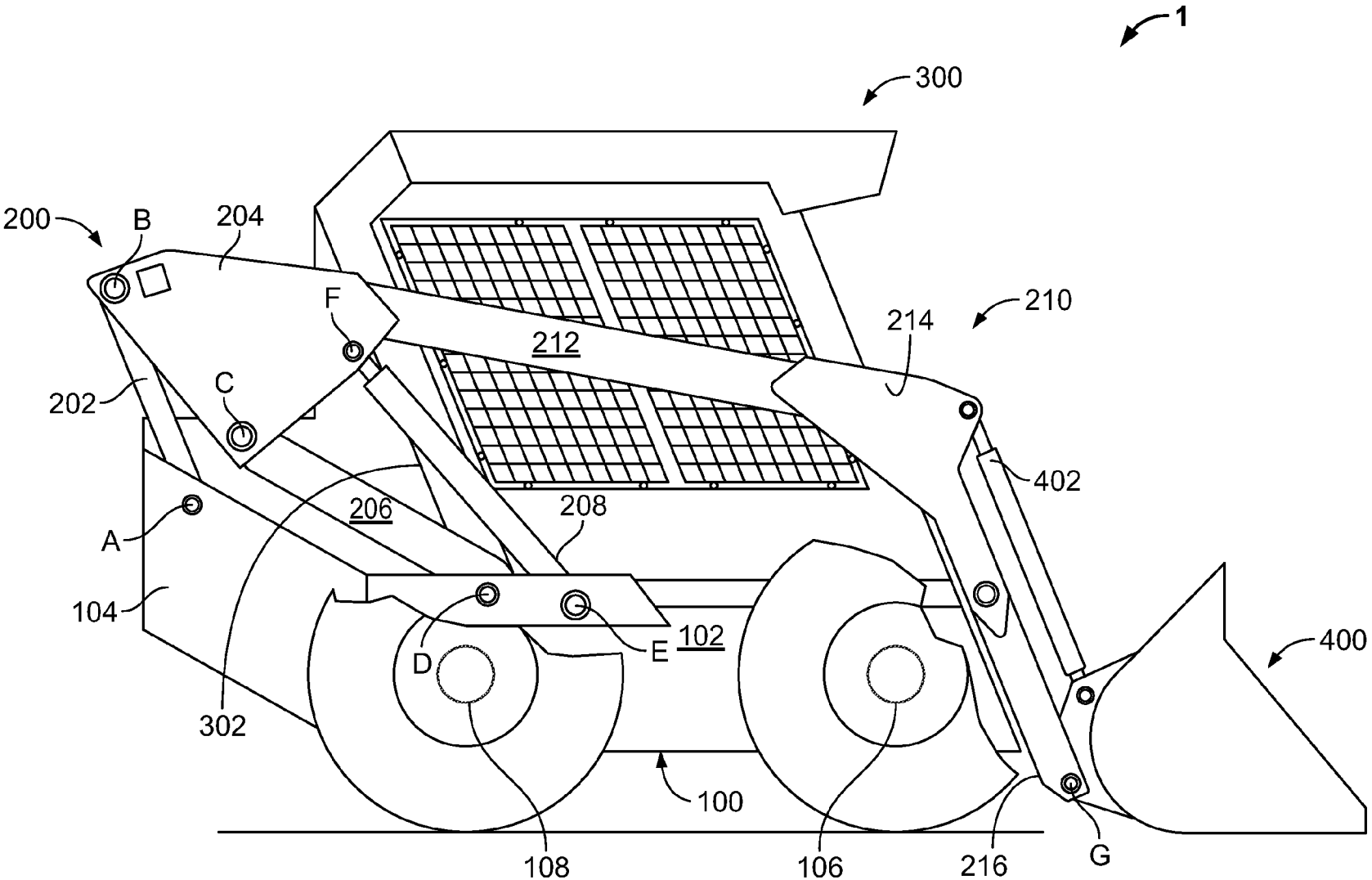
FIG. 1 is an elevation view of a skid steer loader according to a first embodiment.

As shown in FIG. 1, a skid steer loader 1 according to a first embodiment includes a frame 100. An operator compartment 300 is attached to the top of the frame 100. The frame 100 includes a base 102, on which a plurality of wheels or a pair of tracks are rotatably mounted on front and rear axles 106, 108 or the like, and a rearward extending engine-mounting portion 104 that houses drive components (not shown) such as an engine and hydraulic pumps. Alternative or additional drive components such as chains, hydraulic motors, a transmission, drive shafts, electric motors or the like may be housed within the base. The drive components provide motive power to the skid steer loader in addition to driving a hydraulic pump to provide pressurized fluid for hydraulic actuators 208 and 402. The implement actuator 402 actuates a tipping motion of an implement, such as a bucket 400, and the hydraulic lift actuator 208 extends and retracts a lift assembly.

The frame 100 includes a plurality of pivot points A, D, E. In the embodiment shown in FIG. 1, the pivot points A, D, E are generally disposed with pivot points A at the rear of the skid steer loader on the engine-mounting portion 104 of the frame 100, pivot points D between pivot points A and E, and pivot points E forward of and above the rear axle 108 in one embodiment. Pivot points A may be disposed above pivot points D and E. Although only one of each pivot point is shown, duplicate pivot points are provided on the side of the frame which is not shown.

Figure 2:
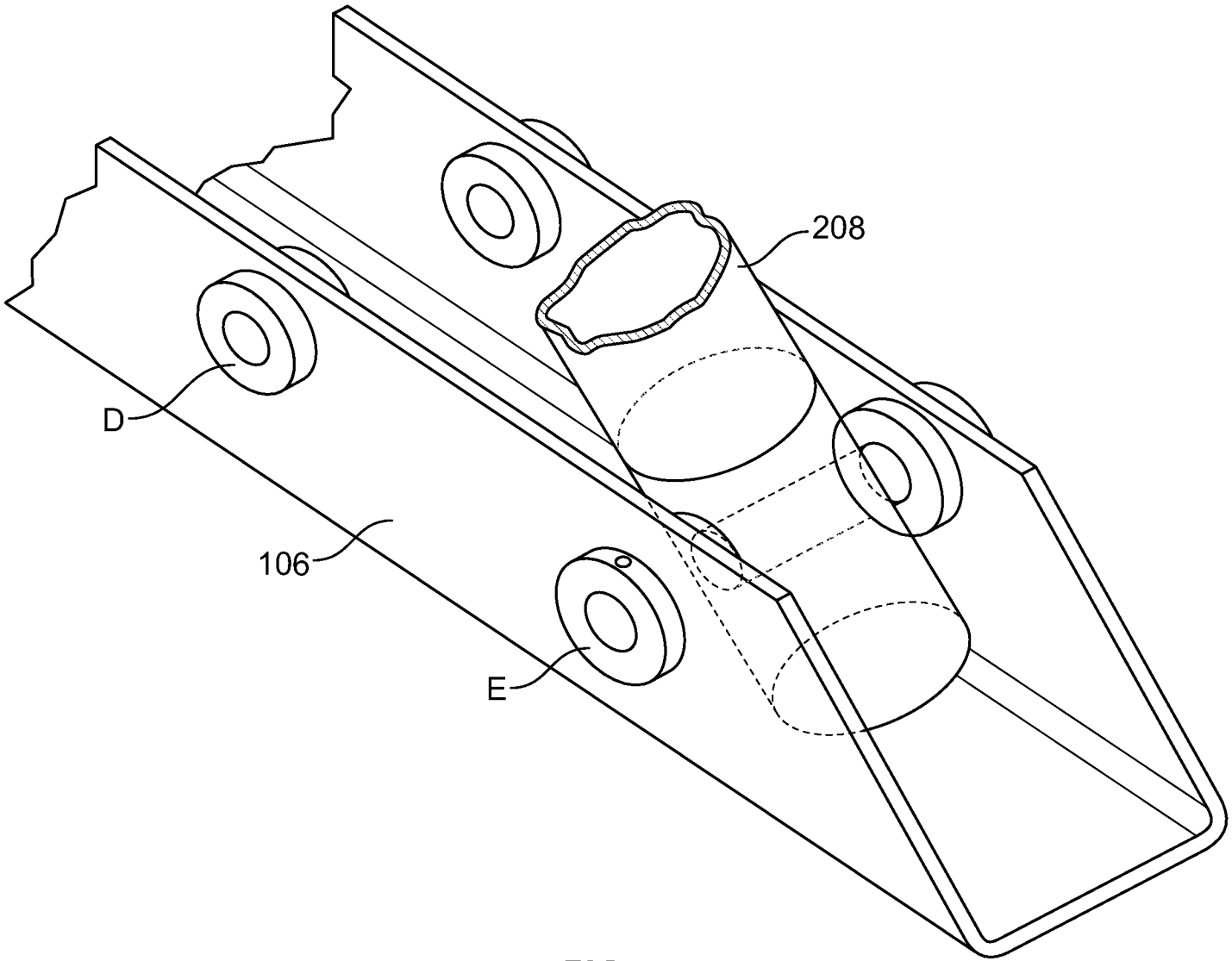
FIG. 2 is an enlarged, partial perspective view of a frame member according to the first embodiment.

As shown in FIGS. 1 and 2, the frame includes U-shaped brackets 106 in which respective pivot points A, D, E are formed. Holes are formed in the brackets 106 at each pivot point in such a manner as to allow shafts or pins, preferably double-shear pins, to be placed in the holes and to rotate in the holes. Alternatively, the holes may be formed through a wall of the frame 100 itself, or through such other structure on the frame 100 that is sufficiently strong to withstand the loads placed on it during the course of use of the skid steer loader. Also, the brackets may be any shape sufficient for the purpose; a U-shape is not essential.

Figure 3:
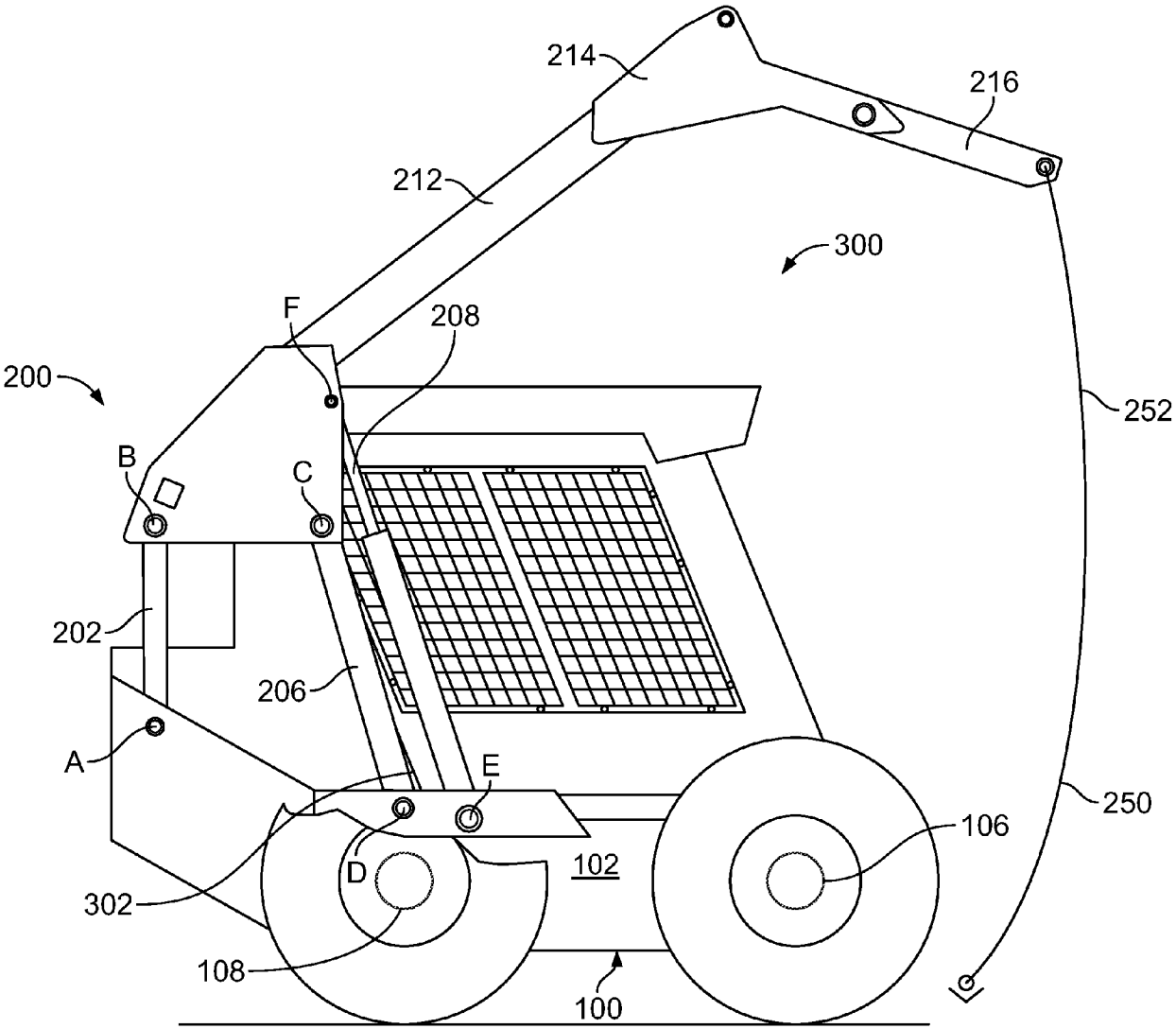
FIG. 3 is an elevation view of a skid steer loader according to the first embodiment with a lift assembly fully extended.
Figure 4:
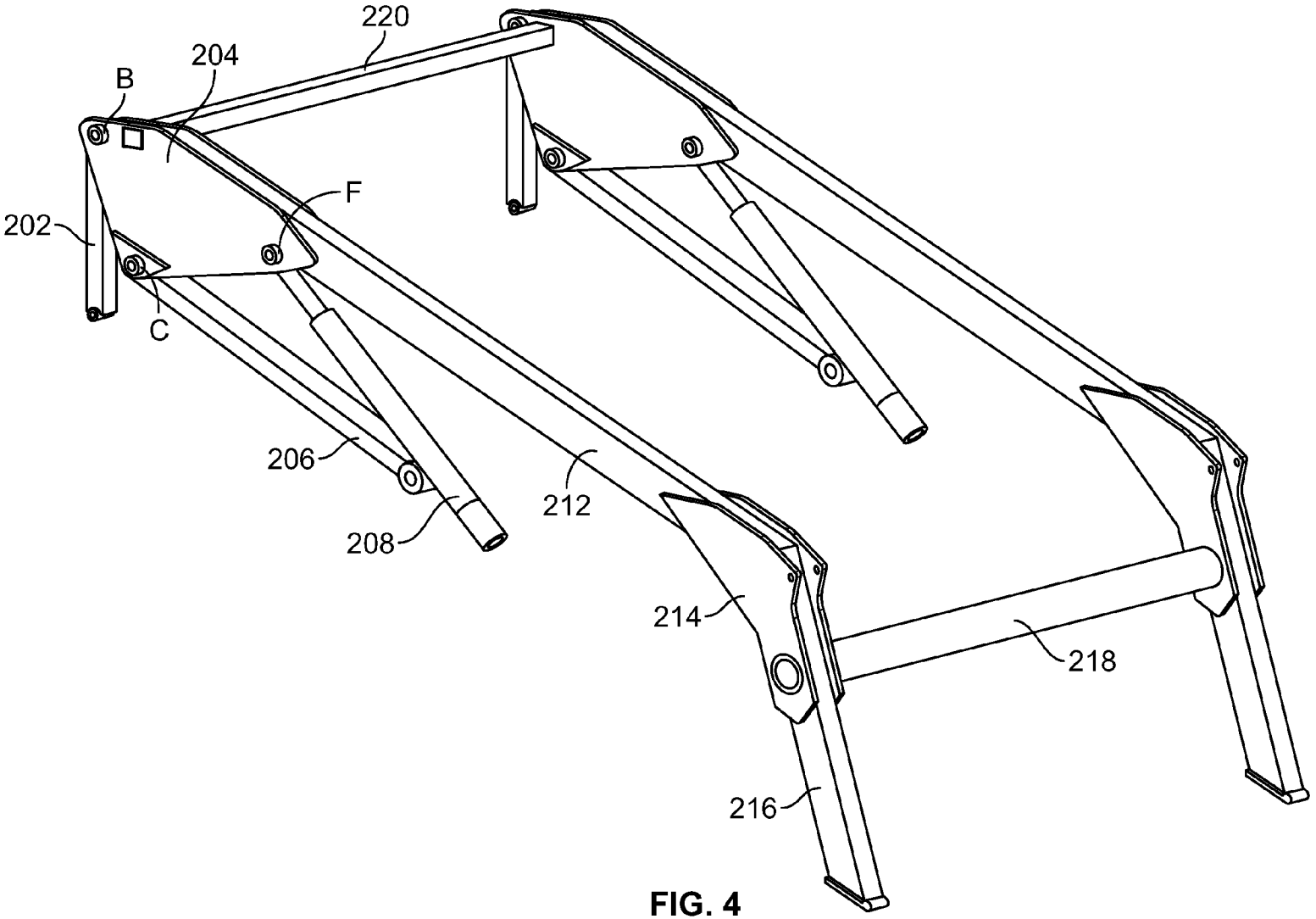
FIG. 4 is a perspective view of the lift assembly shown in FIGS. 1 and 3.
Figure 6:
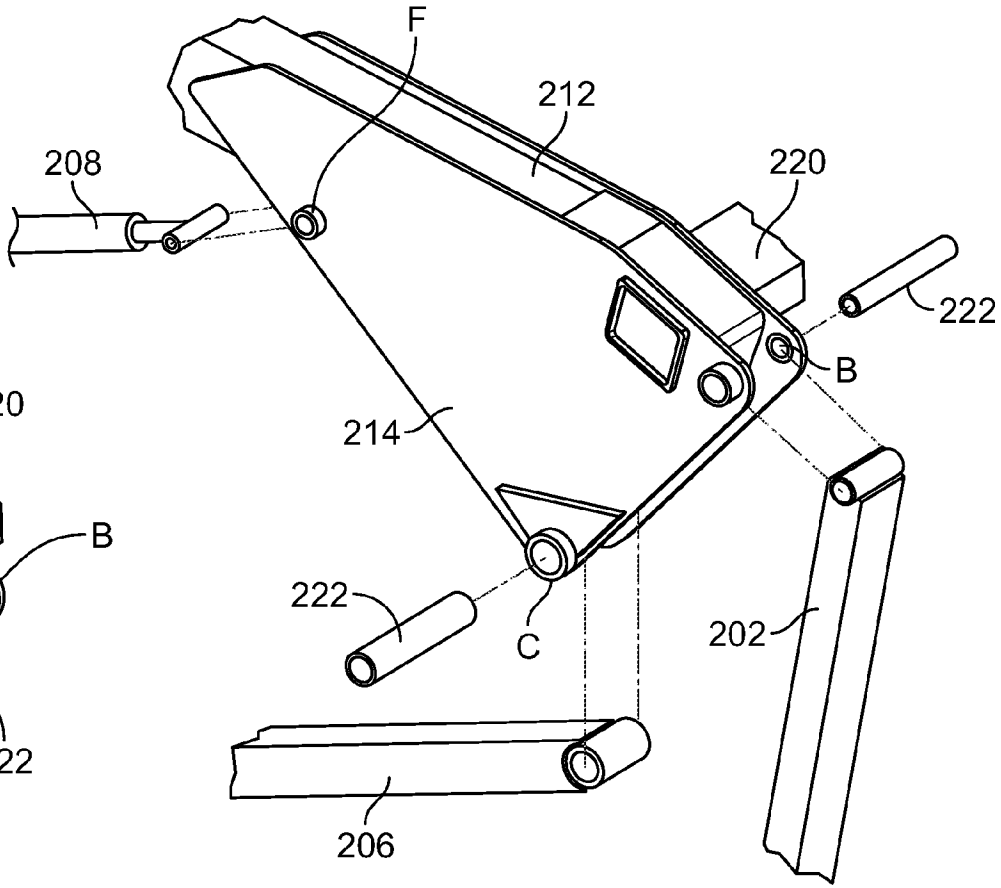
FIGS. 5 and 6 are enlarged partial views of the lift assembly shown in FIGS. 1, 3 and 4.
Figure 5:
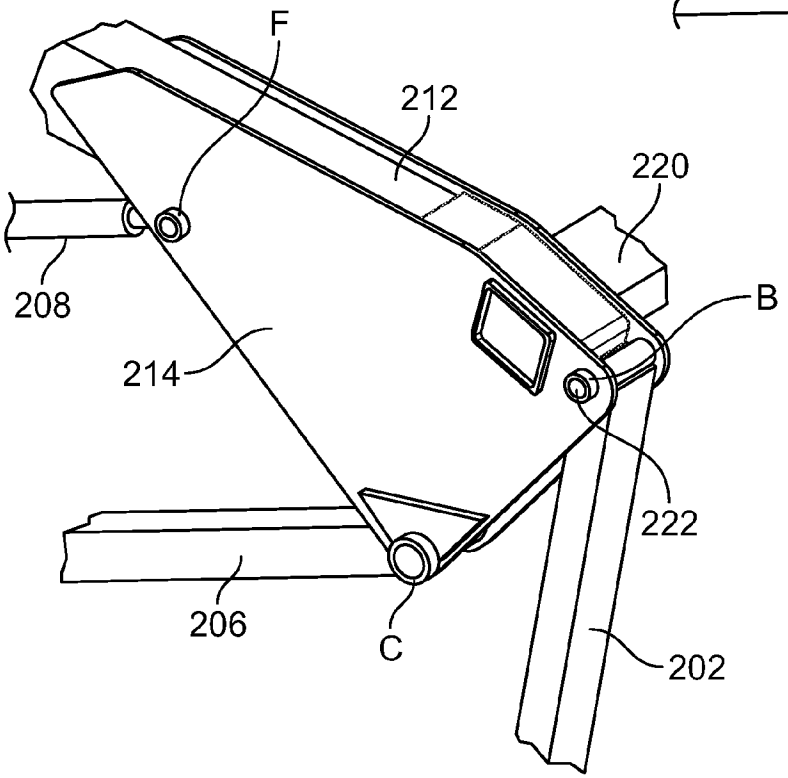

As shown in FIG. 1, lift assemblies 200 are attached to either side of the frame 100 at the pivot points A, D, E (only one side of the frame 100 is shown in FIGS. 1 and 3) such that the lift assemblies 200 are movable relative to the frame 100. Each lift assembly 200 has a first link 202, a second link 206, a pair of rear joining plates 204 (only one joining plate is shown in FIG. 1), a hydraulic lift actuator 208, and a boom 210. Each boom 210 has a top arm 212 and a front arm 216 joined by a pair of front joining plates 214. As shown in FIGS. 4-6, a pair of joining plates 214 connects a respective top arm 212 and front arm 216 such as by welding. Likewise, the rear joining plates 204 connect respective top arm 212.

Each first link 202 is pivotally connected to the frame 100 at pivot point A and to the joining plate 204 at point B, while each second link 206 is pivotally connected to the frame at pivot point D and to the joining plate 204 at pivot point C, and each lift actuator 208 is pivotally connected to the frame, proximate the operator compartment 300, at pivot point E and to the joining plate at pivot point F. Pivot points B, C and F may each be disposed near corners of the rear joining plate, with pivot points B being disposed near the rear of the joining plates when the lift assemblies are in the retracted position, pivot points C near the bottom and pivot points F near the front and just below where the booms and the joining plates are welded (or otherwise coupled) together.

As shown in FIGS. 1 and 3, the first links 202, the rear joining plates 204 between pivot points B and C, the second links 206 and the frame between pivot points D and A form a four-bar linkage. The lengths of the components making up the four-bar linkage are such that the first and second links are oscillating or rocking links. It will be understood that the position of the pivot points can be altered to accommodate different lengths for the first links, the second links and the lift actuators. Moreover, although the rear joining plates are shown in FIGS. 1 and 2 as having a pentagonal shape, it will be understood by one having ordinary skill in the art that the shape can be any number of shapes, such as polygons with more or fewer sides, a whole or part of a circle or ellipse, and the like. Regardless, the joining plates are shaped in one embodiment so that the first and second links are as short as possible while maintaining an acceptable maximum height for the bucket 400. Shorter links are less susceptible to collapsing under compressive loads and are more cost effective than longer links.

FIG. 3 shows the lift assemblies 200 in their fully raised position. In traversing the path from the retracted position shown in FIG. 1 to the raised position shown in FIG. 3, a lower point on the front arms 216 travels in a generally bifurcated path, including a lower path section 250 and an upper path section 252. The bifurcation point occurs when the pivot points B, C and D are aligned.

In one embodiment, the lower path section 250 is substantially half of the path and is shaped as a slowly curving line that is bowed slightly away from the skid steer loader. The upper section 252 is substantially linear and angled slightly away from the skid steer loader. In this way, the lower points G of the front arms 216, which constitute a connection point for the bucket 400 or implement, begin moving away from the frame of the skid steer loader as soon as an operator starts extending the lift assemblies 200, and the lower points G generally continue to move away from the frame without exhibiting a substantially retrograde motion toward the frame. Slight retrograde motion, or retrograde motion over small sections of the path of the lower points G, is possible, but generally the lower points G move away from the frame throughout the entire path, i.e., between fully retracted and fully extended positions.

While traversing the lower path section 250, the lift assemblies generally exhibit high mechanical advantage and low speed. That is, mechanical advantage is relatively high—allowing an operator to lift heavy items—but the speed of the lower points G is relatively slow. In contrast, while traversing the upper path section 252, the lift assemblies generally exhibit lower mechanical advantage but higher speed.

In operation, the lift assemblies 200 are extended by extending the lift actuators 208 so as to move pivot points F along a curve taking them further from pivot points E (which are fixed on the frame 100). As the lift actuators 208 are extended, the first links 202 and the second links 206 rotate clockwise about their respective pivot points A and D. Pivot points B and C travel about a circular arc with the center of the circle being pivot points A and D, respectively.

As shown in FIG. 4, the skid steer loader has a pair of lift assemblies 200 joined by a rear cross member 220 and a front cross member 218. The rear cross member 220 is welded or otherwise rigidly attached to at least one of the pair of rear joining plates 204. Alternatively, the rear cross member 220 could be welded or otherwise rigidly attached to the first links 202 or in other positions, provided the rear cross member 220 provides rigidity. The front cross member 218 is welded or otherwise rigidly attached to at least one of the front joining plates 214. Alternatively, the front cross member 218 could be welded or otherwise rigidly attached in other positions, provided the front cross member 218 lends rigidity to the lift assemblies 200.

As shown in FIGS. 4-6, the placement of the joining plates and pivot points A-F in the rear joining plate and on the frame allow each lift actuator 208 and respective first and second links 202, 206 to move substantially in the same plane between the fully retracted and extended positions. The associated boom 210 also moves in this plane with the respective first and second links. As a result, each lift assembly 200 is not subjected to twisting moments about its longitudinal axis. In other words, by virtue of the single-plane construction of each lift assembly 200 and the lift assembly's connection to the frame, forces, including torsional forces, exerted on one side of the lift assembly as a result of lifting a heavy implement or bucket full of material act in a single plane substantially coinciding with the plane of the first and second links, the lift actuator and the boom 210. Without having to contend with torsional forces, pin connections 222 (shown in FIG. 6) may be thinner and less expensive than is required in applications where any one of the front arm 216 (shown in FIG. 4), links 202, 206 and lift actuator 208 is positioned in a different plane than the top arm 212.

As shown in FIGS. 5 and 6, the pivot pins are double-shear pins. Such pins are easier to manufacture (and therefore less expensive) than single-shear pins. Double-shear pins are subject to shear loading on two, generally parallel planes. In contrast, single-shear pins are subject to a larger shear loading on only one plane and generally require more structure than double-shear pins.

In addition to using less expensive pivot pins, the skid steer loader according to the first embodiment may include lift assemblies having pre-formed tubing. The use of such tubing is made possible because of the lack of twisting moments and is generally less expensive than a custom-formed, welded lift assembly.

Figure 7:
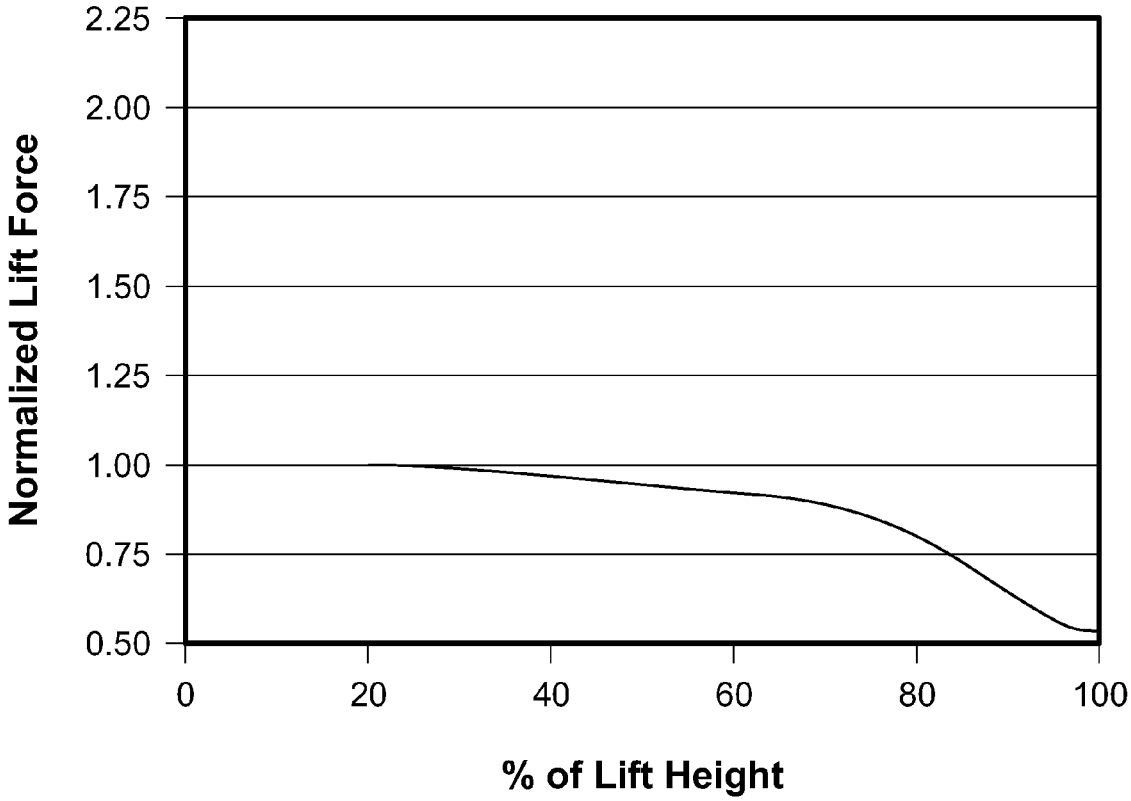
FIG. 7 is a graphic representation of normalized lift force that can be applied by a lift actuator of the skid steer loader according to the first embodiment.

The skid steer loader according to the first embodiment has an advantage of providing the greatest lift force when the lift assemblies are fully retracted (as shown in FIG. 7), and the lift force remains at this maximum level as the lift assemblies are raised until approximately 30% of the maximum lift height is achieved. Even at 75% of maximum lift height, 90% of maximum breakout force is available. Accordingly, if an operator wishes to pry a root or chunk of concrete or asphalt from the ground, he can do so with the maximum force available. Moreover, if an item is so heavy as to exceed the maximum lift capability of the lift actuators, yet must be lifted and transported, the item can be lifted to a working height and moved. Therefore, the greatest lifting force is available when it is most needed—in contrast to many prior art designs that generate the greatest lift force at less useful positions, such as near the top of the maximum bucket height.

By attaching the first links 202 to the frame 100 at pivot points A and to the joining plates 204 at pivot points B, the second links 206 to the frame at pivot points D and to the joining plates 204 at pivot points C, and the lift actuators 208 to the frame, proximate the operator compartment 300, at pivot points E and to the joining plates at pivot point F, the operator's field of vision is enhanced. As all the pivot points A, B, C, D, E and F are positioned proximate a rear wall or back surface 302 of the operator compartment, behind where the operator sits in the operator compartment 300, the first links 202, the second links 206, the lift actuators 208 and the joining plates 204 are all positioned behind the operator and out of the critical line of sight of the operator. The critical line of sight of the operator is in front of and to the left and right sides of the operator. As shown in FIGS. 1 and 3, the critical line of sight of the operator is not impeded when the links 202, 206, lift actuators 208 and joining plates 204 of the lift assemblies are lowered or raised or in any position therebetween. Consequently, the operator will have an unobstructed view of his work area and surroundings, thereby providing for ease of operation and increased safety.

It is typical in many skid steer loaders to have parts of the engine and other components mounted below the operator compartment 300. For ease of service, the operator compartment 300 can be opened or pivoted to allow access to the parts of the engine and other components. In previous skid steer loaders, the lift assemblies have been mounted to the operator compartment or designed in such a manner as to prevent easy access to the operator compartment and the components mounted under the operator compartment. However, in the embodiment shown, the attachment of the first links 202, the second links 206 and the lift actuators 208 is to the frame 100 and not to the operator compartment 300. This construction allows for the operator compartment 300 to be easily opened or pivoted to allow for better service access to parts of the engine and other components. In addition, since the first links 202, the second links 206 and the lift actuators 208 are all mounted at the rear of the skid steer loader 1, the operator compartment 300 can easily be pivoted forward whether the lift assemblies 600 are lowered or raised or in any position therebetween.

Figure 8:
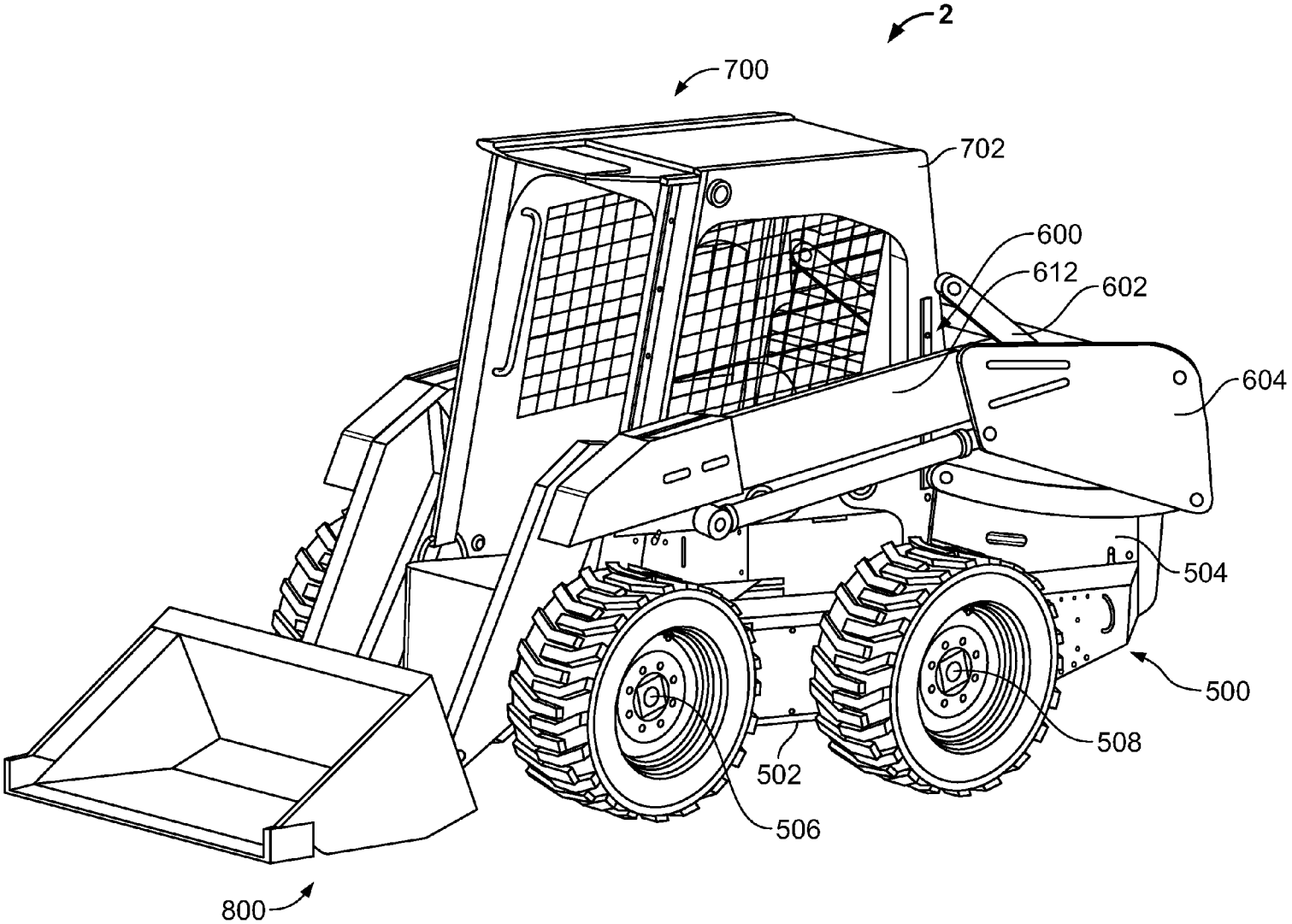
FIG. 8 is a perspective view of a second embodiment of a skid steer loader.
Figure 9:
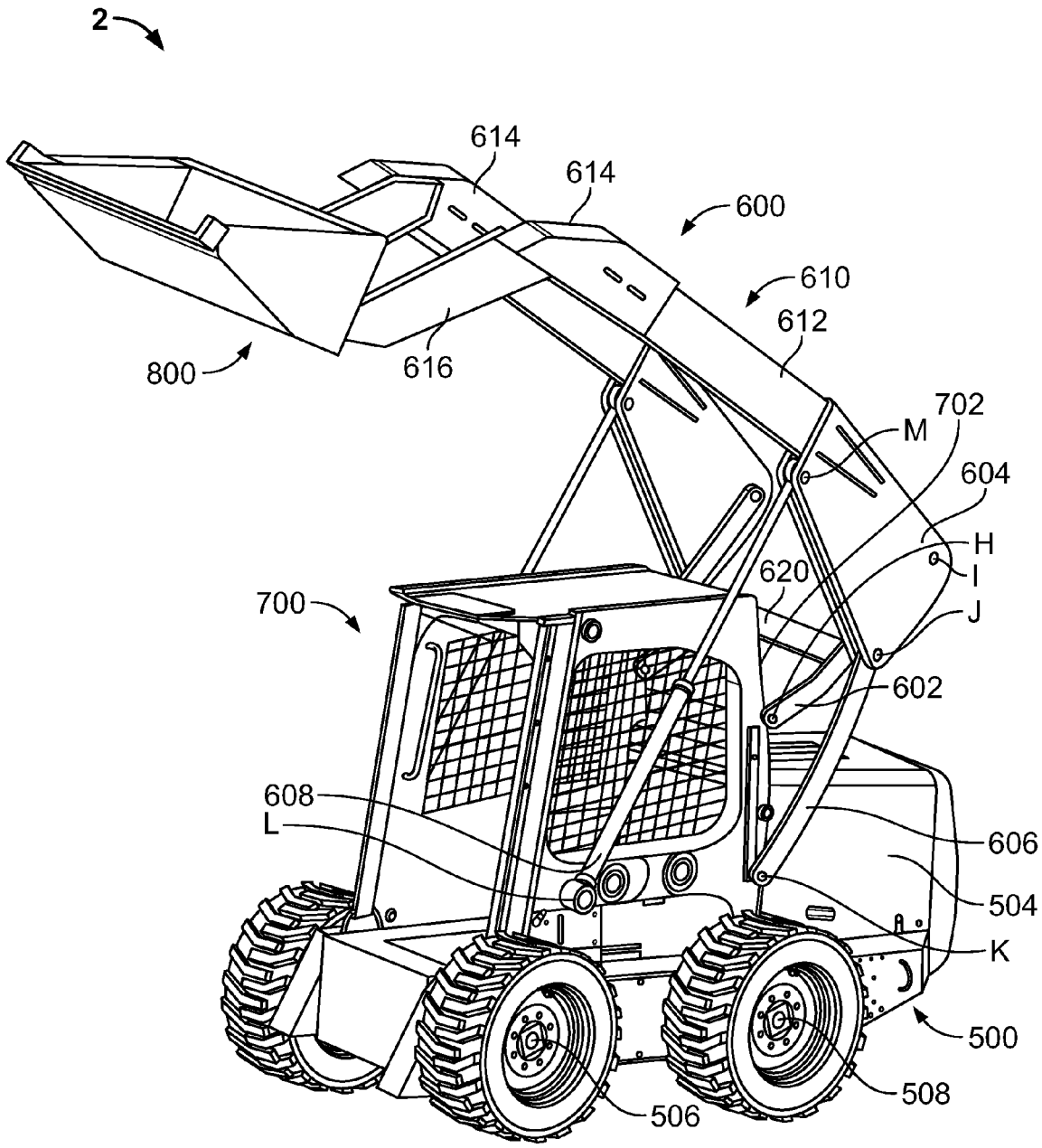
FIG. 9 is a perspective view of the second embodiment of the skid steer loader of FIG. 8 with a lift assembly fully extended.
Figure 10:
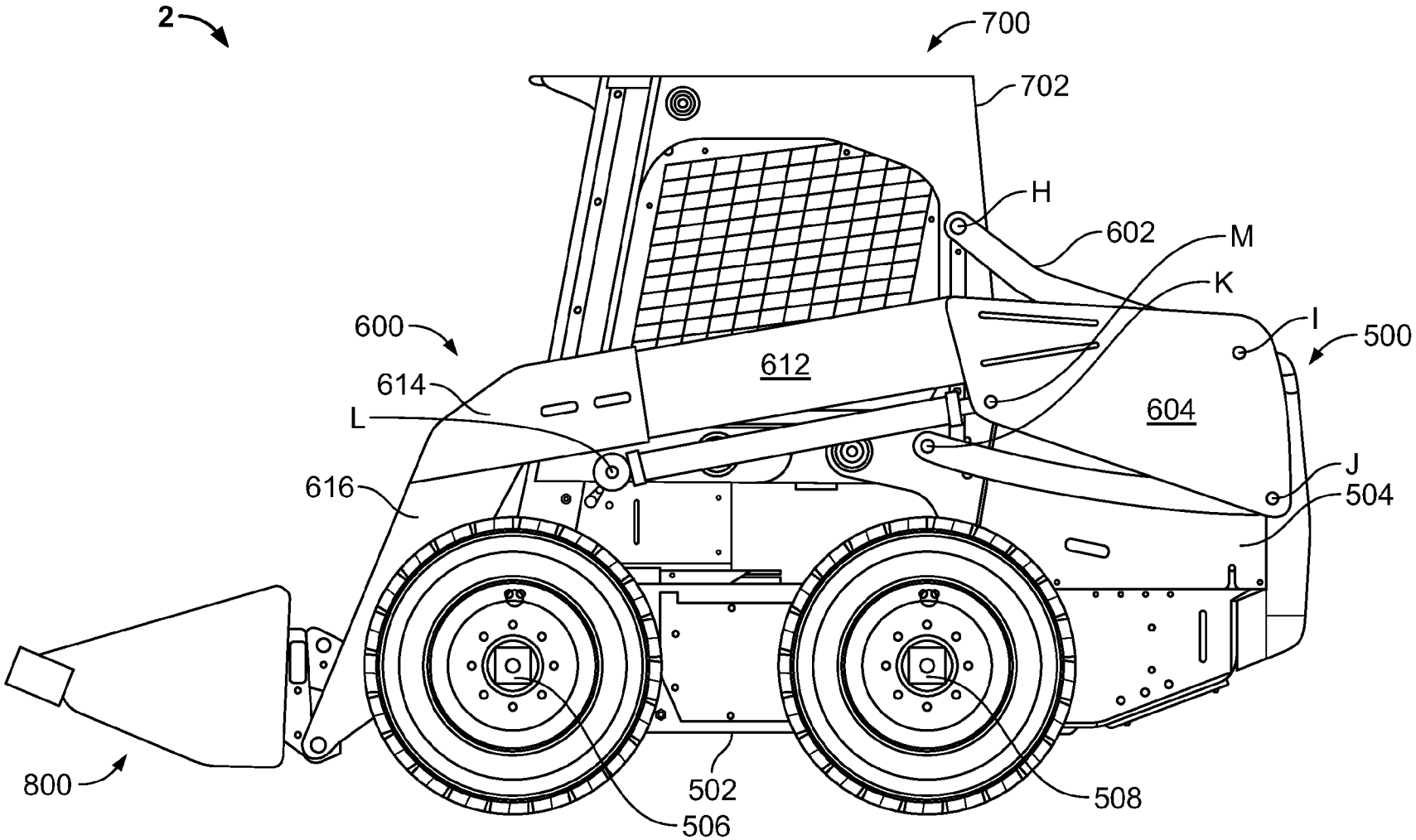
FIG. 10 is an elevation view of the second embodiment of the skid steer loader of FIG. 8.

As shown in FIGS. 8 through 10, a skid steer loader 2, according to a second embodiment, includes a frame 500. An operator compartment 700 is attached to the top of the frame. The frame 500 includes a base 502, on which a plurality of wheels or a pair of tracks are rotatably mounted on front and rear axle 506, 508 or the like, and a rearward extending engine-mounting portion 504 that houses drive components such as those previously described, or additional drive components such as chains or hydraulic motors. The drive components provide motive power to the skid steer loader, in addition to driving hydraulic pumps to provide pressurized fluid for hydraulic implement actuators which move a bucket 800 and extend and retract lift assemblies 600.

The frame 500 includes a plurality of pivot points H, K, L. In the embodiment shown in FIG. 10, the pivots points H, K, L are generally disposed with pivot points L mounted on the frame 500 above the front axle 506 and pivot points H, K mounted on the frame 500 above the rear axle 508. Pivot points H are disposed above pivot points K and L. Holes may be formed through a wall of the frame 500, at each pivot point or through such other structure on the frame 500 that is sufficiently strong to withstand the loads placed on it during the course of use of the skid steer loader.

As shown in FIGS. 8 through 10, the lift assemblies 600 are attached to the frame 500 at the pivot points L, K, H such that the lift assemblies 600 are movable relative to the frame 500. The lift assemblies 600 have first links 602, second links 606, rear joining plates 604, lift actuators 608, and booms 610. Each boom 610 has a lift arm or top arm 612 and a front arm 616 joined by a pair of front joining plates 614, which may be integral with the front arm 616. As shown in FIGS. 8-10, a pair of joining plates 614 connects a respective top arm 612 and front arm 616, such as by welding. Likewise, the rear joining plates 604 connect the top arms 612.

The first links 602 are pivotally connected to the frame 500 at pivot points H and to the joining plates 604 at pivot points I, while the second links 606 are pivotally connected to the frame at pivot points K and to the joining plates 604 at pivot points J, and the lift actuators 608 are pivotally connected to the frame, proximate the operator compartment 700, at pivot points L and to the joining plates at pivot points M. Pivot points I, J and M may each be disposed near corners of the rear joining plates, with pivot points I and J being disposed near the rear of the joining plates when the lift assemblies are in the retracted position, pivot points J near the bottom and pivot points M near the front and just below where the booms and the joining plates are welded (or otherwise coupled) together.

As shown in FIGS. 8 through 10, the first links 602, the rear joining plates 604 between pivot points I and J, the second links 606 and the frame between pivot points K and H form a four-bar linkage. The lengths of the components making up the four-bar linkage are such that the first and second links are oscillating or rocking links. Nevertheless, it will be understood that the position of the pivot points can be altered to accommodate different lengths for the first links, the second links and the lift actuators. Moreover, although the rear joining plates are shown in FIGS. 8 through 10 as having a trapezoidal shape, it will be understood by one having ordinary skill in the art that the shape can be any number of shapes, such as polygons with more or fewer sides, a whole or part of a circle or ellipse, and the like. Regardless, the joining plates are shaped in one embodiment so that the first and second links are as short as possible while maintaining an acceptable maximum height for the bucket 800. Shorter links are less susceptible to collapsing under compressive loads and are more cost effective than longer links. In the embodiment shown, the links 602, 606 have a slightly arcuate configuration, but other configurations of the links can be used.

FIG. 9 shows the lift assemblies 600 in their fully raised position. In traversing the path from the retracted position shown in FIG. 8 to the raised position shown in FIG. 9, lower points on the front arms 616 travel in a generally flattened S-shape as shown in FIG. 10.

In operation, the lift assemblies 600 are extended by extending the lift actuators 608 so as to move pivot points M along a curve taking them further from pivot points L (which are fixed on the frame 500). As the lift actuators are extended, the first links 602 and the second links 606 rotate counterclockwise about their respective pivot points H and K. Pivot points I and J travel about a circular arc with the center of the circle being pivot points H and K, respectively.

As shown in FIGS. 9 and 10, the skid steer loader has a pair of lift assemblies 600 joined by a rear cross member 620 and the bucket 800. The rear cross member 620 is welded or otherwise rigidly attached to the first links 602. Alternatively, the rear cross member 620 could be welded or otherwise rigidly attached to the rear joining plates 604 or in other positions, provided the rear cross member 620 provides rigidity. The bucket 800 is pivotally mounted or otherwise attached to the front arms 616 proximate the free ends thereof.

As shown in FIGS. 8 and 9, the placement of the pivot points J, M in the rear joining plates and on the frame allows each hydraulic lift actuator 608 and respective second link 606 to move substantially in the same plane between the fully retracted and extended positions. The associated boom 610 also moves in this plane with the respective second link. As a result, each lift assembly 600 is not subjected to twisting moments about its longitudinal axis. In other words, the majority of moments and forces, including torsional forces, exerted on one side of the lift assembly as a result of lifting a heavy implement or bucket full of material act in a single plane substantially coinciding with the plane of the second link 606, the hydraulic lift actuator 608 and the boom 610.

By attaching the first links 602 to the frame 500 at pivot points H and to the joining plates 604 at pivot points I, the second links 606 to the frame at pivot points K and to the joining plates 604 at pivot points J, and the lift actuators 608 to the frame, proximate the operator compartment 700, at pivot points L and to the joining plates at pivot points M, the operator's field of vision is enhanced. As the pivot points H, I, J, and K are positioned proximate a rear wall or back surface 702 of the operator compartment, behind where the operator sits in the operator compartment 700, the first links 602, the second links 606, and the joining plates 604 are all positioned behind the operator and out of the critical line of sight of the operator. As shown in FIG. 8, the critical line of sight of the operator is not impeded when the lift assemblies 600 are lowered as the booms 610 are provided proximate the frame 500. In this position, the longitudinal axis of the top arms 612 of the booms 610 is positioned between pivot points H and K. When lift assemblies 600 are raised, as shown in FIG. 9, only the lift actuators 608 are positioned adjacent the operator compartment 700. Consequently, the operator will have a generally unobstructed field of view of the work area and surroundings when the links 602, 606, lift actuators 608 and joining plates 604 of the lift assemblies 600 are raised, and an unobstructed view of the work area and surroundings when the lift assemblies 600 are lowered, thereby providing for ease of operation and increased safety.

It is typical in many skid steer loaders to have parts of the engine and other components mounted below the operator compartment 700. For ease of service, the operator compartment 700 can be opened or pivoted to allow access to parts of the engine and other components. In previous skid steer loaders, the lift assemblies have been mounted to the operator compartment or designed in such a manner as to prevent easy access to the operator compartment and the components mounted under the operator compartment. However, in the embodiment shown, the attachment of the first links 602, the second links 606 and the lift actuators 608 are to the frame 500 and not to the operator compartment 700. This construction allows for the operator compartment 700 to be easily opened or pivoted to allow for better service access to parts of the engine and other components. In addition, as the first links 602, the second links 606 and the lift actuators 608 are all mounted at the rear of the skid steer loader 2, the operator compartment 700 can easily be pivoted forward whether the lift assemblies 600 are lowered or raised or in any position therebetween.

The positioning of the pivot points on the frame, where substantial structure must be provided to strengthen the base regardless of the presence of the pivot points, obviates the need to provide additional structure to support the lift assembly. In addition, the placement of the lift actuator is such that the full lift height of the bucket is achieved with a shorter actuator than is possible with some prior-art designs.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A skid steer loader comprising:

a frame;

an operator compartment attached to the frame;

lift assemblies including lift actuators movably mounted to the frame, the lift assemblies being movable between a retracted position and an extended position;

joining plates rigidly coupled to the lift assemblies;

first links pivotally coupled to the frame proximate a rear wall of the operator compartment and pivotally coupled to the joining plates at or near a rear of the joining plates; and second links pivotally coupled to the frame proximate the rear wall of the operator compartment and pivotally coupled between the joining plates and the first links when the lift actuator is fully retracted;

the lift actuators pivotally coupled to the frame proximate the rear wall of the operator compartment and pivotally coupled to the joining plates above and forward of the pivotal coupling between the joining plates and the second links when the lift actuators are fully retracted;

wherein as the lift assemblies are moved between the retracted position and the extended position, the joining plates, the first links and the second links are positioned behind the rear wall of the operator compartment, the lift actuators being adapted to extend between a first position and a second position, and as the actuators are moved to the second position, the lift assemblies are moved to the extended position.

2. A skid steer loader according to claim 1 wherein the lift assemblies have top arms which are proximate the base when the lift assemblies are in the retracted position, so that when the lift assemblies are in the retracted position, the field of vision from the operator compartment to either side is unobstructed.

3. A skid steer loader according to claim 1 wherein the operator compartment is movably disposed on top of the frame, the operator compartment being movable independent of a position of the lift assemblies.

4. A skid steer loader comprising:

a frame including at least a front axle, a rear axle and a base;

an operator compartment attached to the frame;

joining plates;

lift assemblies rigidly coupled to the joining plates, the lift assemblies being movable between a retracted position and an extended position, the lift assemblies including lift actuators pivotally coupled to the joining plates and to the base above and in front of the rear axle and above and behind the front axle;

first links pivotally coupled to the joining plates, and pivotally coupled to a back portion of the frame proximate a rear wall of the operator compartment;

second links pivotally coupled to the joining plates, and pivotally coupled to the frame proximate the rear wall of the operator compartment, the second links being pivotally coupled to the frame at a position below where the first links are pivotally coupled to the frame; and the lift assemblies having lift arms which extend from the first and second links in a direction toward a front of the frame, the lift arms positioned proximate the base when the lift assemblies are in the retracted position, wherein a longitudinal axis of each lift arm extends between the position where the first links are pivotally coupled to the frame and the position where the second links are pivotally coupled to the frame when the lift assemblies are in the retracted position, such that when the lift assemblies are in the retracted position, the field of vision on either side of the operator compartment is unobstructed.

5. A skid steer loader according to claim 4 wherein the operator compartment is movably disposed on top of the frame, the operator compartment being movable independent of a position of the lift assemblies.

6. A skid steer loader according to claim 5 wherein the first links are pivotally coupled to the joining plates at or near a rear of the joining plate, the second links being pivotally coupled to the joining plates forward of and below the first link when the lift actuator is fully retracted, and the lift actuators pivotally coupled to the joining plates above and forward of the pivotal coupling between the joining plates and the second links when the lift actuators are fully retracted.

7. A skid steer loader according to claim 6 wherein the lift actuators are adapted to extend between a first position and a second position, and as the actuators are moved to the second position, the lift assemblies are moved to the extended position.

8. A skid steer loader comprising:

a frame;

a first link pivotally coupled to the frame at a first-link pivot;

a second link pivotally coupled to the frame at a second-link pivot;

a lift actuator adapted to extend and retract between fully retracted and fully extended positions, the lift actuator being pivotally coupled to the frame at a lift-actuator pivot;

a joining plate pivotally coupled to the first link, the second link and the lift actuator at a first-link-plate pivot, a second-link-plate pivot and a lift-actuator-plate pivot, respectively, the first-link-plate pivot pivotally coupled to the joining plates at or near a rear of the joining plate, the second-link-plate pivot pivotally coupled to the joining plate forward of and below the first-link-plate pivot when the lift actuator is fully retracted, and the lift-actuator-plate pivot being pivotally coupled to the joining plate above and forward of the second-link-plate pivot when the lift actuators are fully retracted; and a boom rigidly coupled to the joining plate;

wherein the first-link pivot, the second-link pivot and a lift-actuator pivot point are proximate a back of the operator compartment such that, as the boom is moved, the joining plate, the first link and the second link are positioned behind the operator compartment, the second link and the lift actuator being positioned so that in response to movement of the lift actuator from its retracted position to its fully extended position, the second link and the lift actuator remain coplanar such that the forces exerted on one side of the boom act in a plane which coincides with the plane of the second link and the lift actuator.

9. The skid steer loader as recited in claim 8 wherein the first link is provided in the same plane as the second link and the lift actuator wherein as the lift actuator is moved from its retracted position to its fully extended position, the first link, the second link and the lift actuator remain coplanar.

10. A skid steer loader according to claim 8 wherein the operator compartment is movably disposed on top of the frame, the operator compartment movable independent of a position of the boom.

* * * * *